United States Patent [19]

Krah

[11] Patent Number: 4,862,680

[45] Date of Patent: Sep. 5, 1989

[54] BOTTOM-FOLDING PACKER

[75] Inventor: Peter Krah, Remscheid, Fed. Rep. of Germany

[73] Assignee: Maschinenfabrik Alfred Schmermund GmbH & Co., Gevelsberg, Fed. Rep. of Germany

[21] Appl. No.: 181,595

[22] Filed: Apr. 14, 1988

[30] Foreign Application Priority Data

Apr. 14, 1987 [DE] Fed. Rep. of Germany ..... 3712717

[51] Int. Cl.[4] ..... B65B 19/24

[52] U.S. Cl. ..... 53/575; 53/456; 493/164; 493/252; 493/910

[58] Field of Search ..... 53/148, 234, 575; 493/164, 252, 295, 910

[56] References Cited

U.S. PATENT DOCUMENTS

| | | | |
|---|---|---|---|
| 3,140,643 | 7/1964 | Barthelmess | 493/252 |
| 3,750,676 | 8/1973 | Kruse | 53/148 X |
| 4,079,575 | 3/1978 | Focke | 53/234 |
| 4,094,124 | 6/1978 | Ljunggrantz | 493/164 X |
| 4,100,718 | 7/1978 | Focke | 53/575 X |
| 4,330,976 | 5/1982 | Blackall | 53/575 X |

FOREIGN PATENT DOCUMENTS

| | | | |
|---|---|---|---|
| 1905275 | 9/1969 | Fed. Rep. of Germany | 53/575 |

*Primary Examiner*—John Sipos

*Attorney, Agent, or Firm*—Chilton, Alix & Van Kirk

[57] ABSTRACT

Apparatus for the packaging of cigarettes by successively folding inner and outer wrappers about a hollow open-ended mandrel, plural of the mandrels being supported from a rotary turret which is moved in step-wise fashion, which enables the use of a metalized foil as the inner wrapper. The apparatus establishes communication between a low pressure source and the interior of the mandrel during at least a portion of the wrapper folding procedure with the resulting suction being applied to the inner wrapper via an open end of the mandrel and through an array of holes provided in the side of the mandrel where opposite free ends of the inner wrapper are positioned after folding.

8 Claims, 3 Drawing Sheets

BOTTOM-FOLDING PACKER

BACKGROUND OF THE INVENTION (1) Field of the Invention

The present invention relates to the packaging of articles and, particularly, to the formation of cigarette packages by successively folding inner and outer wrappers around pre-formed blocks of cigarettes. More specifically, this invention is directed to apparatus which forms a package by folding an outer wrapper about an article wrapped in a resilient inner wrapper and especially to apparatus which permits formation of such a package using, for the inner wrapper, a metalized foil material which has a tendency to return to its original sheet-like form when released by mechanical folding members of the packaging apparatus. Accordingly, the general object of the present invention are to provide novel and improved methods and apparatus of such character.

(2) Description of the Prior Art

While not limited thereto in its utility, the present invention is particularly well suited for use in apparatus known in the art as "bottom-folding packers" which are employed in the packaging of cigarettes. Such apparatus are characterized by a wrapping turret having plural hollow mandrels located in a geometric pattern, a star arrangement for example. Pre-formed blocks of cigarettes are disposed in the mandrels while inner and outer wrappers are folded thereabout. The wrapping turret will be driven, in step-wise fashion, with the steps comprising the spacing between wrapper folding stations. The apparatus is further comprised of feed devices for supplying both inner and outer wrappers, typically in sheet form, and stationery and moveable folding members for folding the inner wrapper around a mandrel and then for subsequently folding the outer wrapper around the folded inner wrapper.

A "bottom-folding packer" of the type briefly described above, for producing so-called soft packs, is disclosed in published German patent application No. 3,046,063 and WO-80-00246. In the prior art apparatus, the inner wrapper has customarily been comprised of a laminate consisting of a paper coated with aluminum foil. In spite of the fact that the prior art bottom-folding packers do not produce sharp creases when the foil-coated paper is formed around the mandrel, the wrapper is nevertheless sufficiently deformed so that it generally retains its folded shape when released by the folding members of the packer. Such release of the inner wrapper is, of course, necessary in order to permit the addition of the outer wrapper to the partially formed package.

The prior art inner wrapper materials are, when compared to metalized film, relatively expensive. It has, accordingly, for some time been desired to devise a manner in which a package having inner and outer wrappers could be formed employing a metalized film as the inner wrapper. Such efforts have previously been unsuccessful due to the fact that the metalized film is somewhat resilient and thus has a tendency to return to its original form when released by the mechanical folding members of the packer, i.e., unless mechanically restrained, the inner wrapper will spring away from the mandrel or other object about which it has been folded.

SUMMARY OF THE INVENTION

The present invention overcomes the above briefly-discussed and other deficiencies and disadvantages of the prior art and, in so doing, permits the use of metalized film as the inner wrapping of a package comprised of inner and outer wrappers. It is, accordingly, an object of the present invention to provide a bottom-folding packer suitable for use with metalized film inner wrappers. It is also an object of the invention to provide a packaging method wherein a resilient metalized film can be employed as an inner wrapping.

The above objects of the invention are accomplished, in part, by the establishment of a low pressure zone which is in communication with the interior of the mandrels about which the inner and outer wrappers are folded. Accordingly, as the folding of the wrappers progresses, a pneumatic pressure differential is established across the inner wrapper. This pneumatic pressure differential will hold the folded ends of the wrapper in their folded positions. The pressure differential will be effective at least at the end of the mandrel opposite to that where the low pressure is applied and also at a side wall of the mandrel which corresponds to the final flap formed during folding of the inner wrapper. This side wall corresponding to the final formed flap will typically be the trailing wall in the direction of motion of the mandrel during the step-wise rotation of the turret on which it is mounted.

In an embodiment wherein the low pressure zone is established in a duct connected to a vacuum source, that duct will extend over a sector of a circular ring. The duct will be provided, on the side which faces an open end of the mandrels, with an array of suction orifices which lie along the path of movement of the mandrels. The distance between these suction orifices will be less than the width of the mandrels whereby, once a mandrel has moved into operative registration with the duct, the open end thereof will remain in constant communication with the vacuum source until the folding operation is completed.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE DISCLOSED EMBODIMENT

Figure 1:
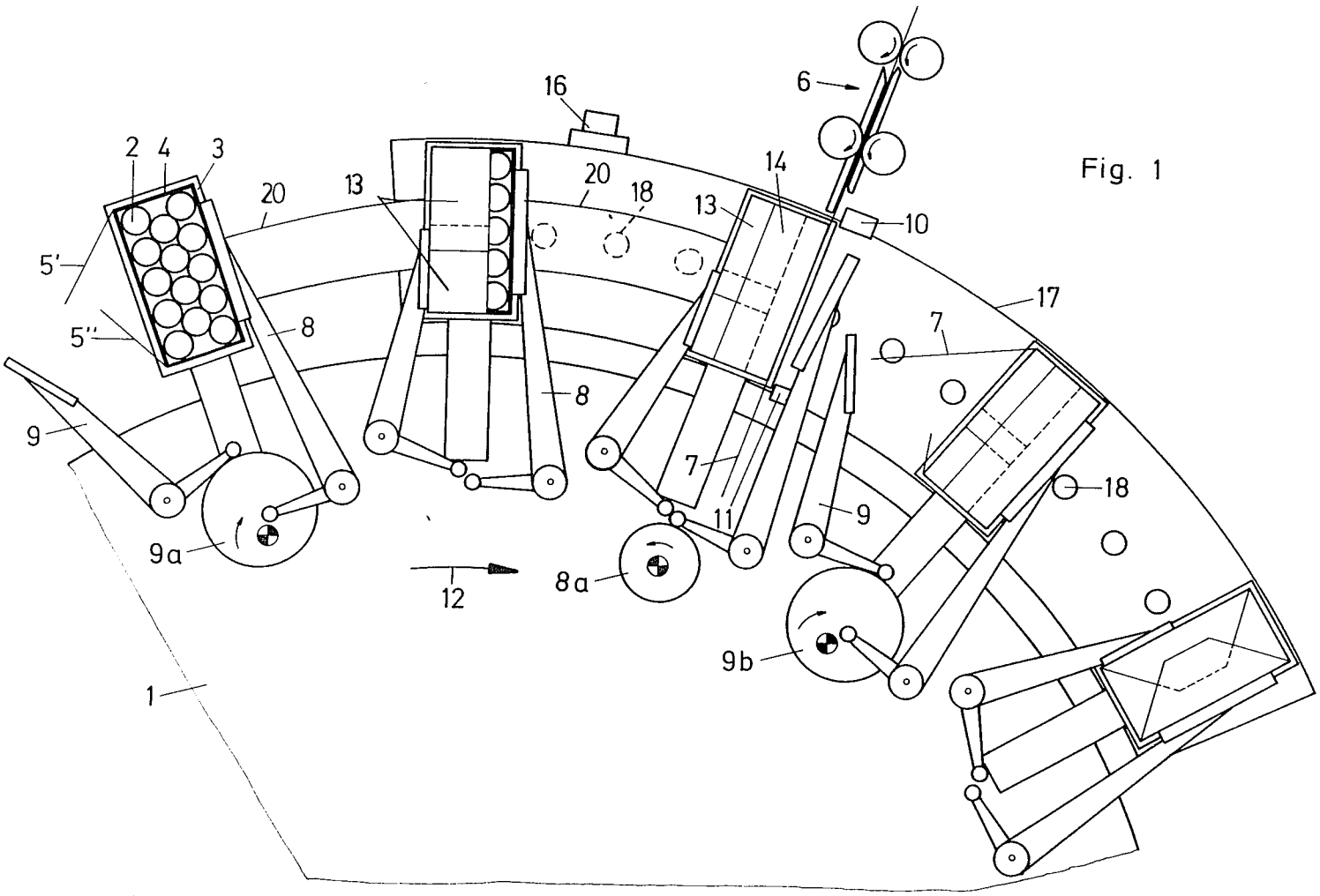
FIG. 1 is a schematic, partial, front elevation view of the turret of a cigarette package-forming machine in accordance with the preferred embodiment of the present invention.
Figure 2B:
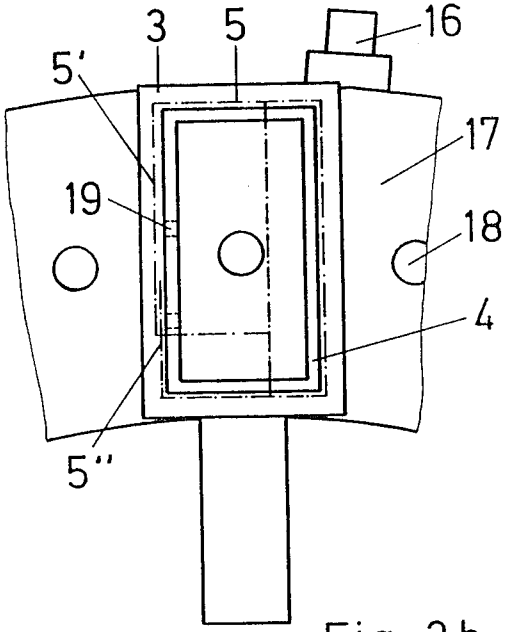
FIG. 2*a* and 2*b* respectively depict one of the mandrels of the turret of FIG. 1 in section and in a front view.
Figure 2A:
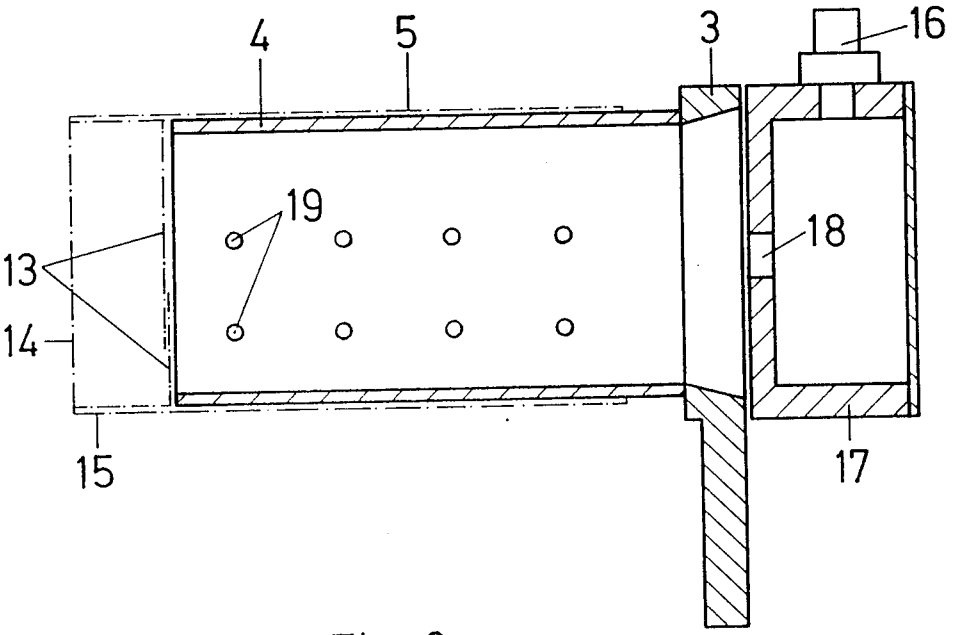
Figure 3A:
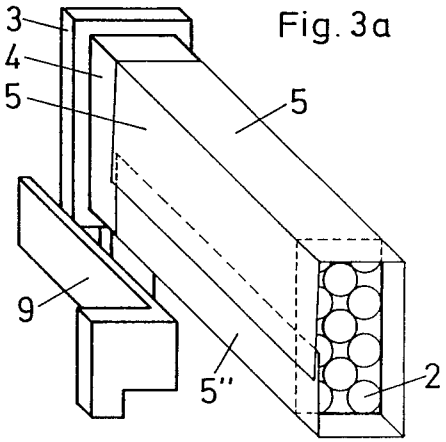
FIGS. 3*a* through 3*f* depict different stages in the formation of a package by means of the folding of inner and outer wrappers around one of the mandrels of FIGS. 1 and 2.
Figure 3B:
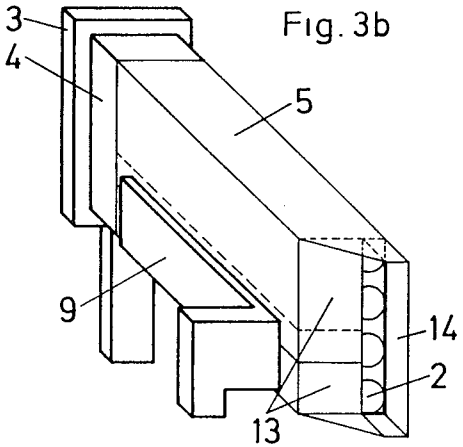
Figure 3C:
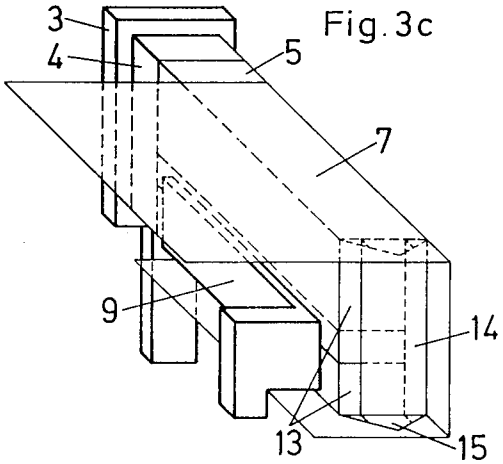
Figure 3D:
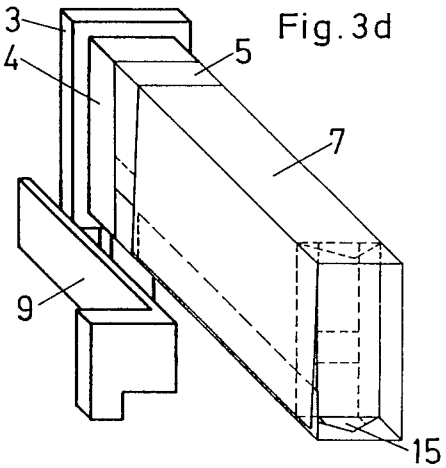
Figure 3E:
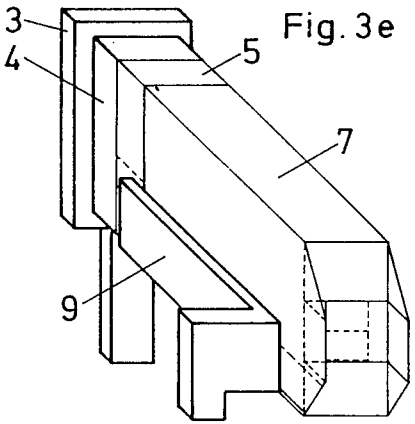
Figure 3F:
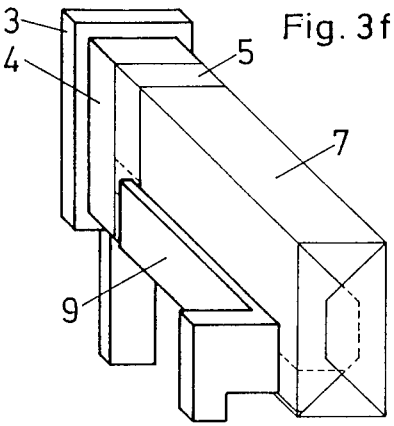

Referring now to the drawing, the disclosed embodiment is designed for use in the packaging of cigarettes, indicated at 2, which have previously been formed into blocks. The packaging apparatus comprises a wrapping turret 1 from which are supported a plurality of hollow open-ended mandrels 4. The pre-formed cigarette blocks are delivered into the mandrels 4 by means of a ram, not shown, which may be associated with a block turret, also not shown. The transfer of the blocks into the mandrels 4 will occur when a fully-loaded cell on the block turret is axially aligned with one of the mandrels 4, the mandrels 4 being provided with head-end mouth pieces 3, best seen in FIG. *2a*, which guide the cigarette blocks into the mandrels 4. The turret 1 is rotated, in the direction of arrow 12, in step-wise fashion during the wrapping process.

A first sheet feed device, not shown, is positioned adjacent to the wrapping turret 1 for supplying an inner wrapper 5. Downstream, in the direction of rotation of turret 1, from the point at which the inner wrapper is supplied, a sheet-feed device 6 supplies the outer wrapper 7. By means of moveable folding members 8,9 and stationery folding members, only two of which 10,11 are partially shown, first the inner wrapper 5 and then the outer wrapper 7 are folded around the mandrel 4 so as to produce a package which is closed at the bottom, i.e., at the end opposite to the mandrel mouth piece 3. The thus partially formed package, together with the cigarette block located in the mandrel, will subsequently be pushed into a head-closing turret, not shown, where the package will be completed by closing the head end thereof.

As noted above, during the wrapping procedure, the turret 1 is rotated by a stepping drive. This drive will move the mandrels a distance equal to one cell division for each step. Such step-wise turret drives are well known in the cigarette packaging art, as shown by the publications incorporated herein by reference, and thus will not be discussed further herein.

The inner wrapper 5 will be supplied to the packer in the form of rectangular sheets of a metalized film. These sheets of inner wrapper are first pressed, by a cam-actuated folding arm 8 mounted on turret 1, against the side wall of the mandrel 4 which leads in the direction of rotation 12 of turret 1. Stationery folding members, not shown but similar to the stationery folding members 10 and 11 which act on the outer wrapper, will cause the inner wrapper 5 to pass about, and conform generally to the shape of, the two sides of the mandrel 4 which extend transversely from the opposite side edges of the leading side wall, i.e., the upper and lower walls of the mandrel 4 which extend generally counter to the direction of rotation. The wrapping 5 is, subsequently, folded against the trailing side wall of the mandrel, thus defining a pair of overlapping flaps 5' and 5''. This last folding is accomplished by means of folding levers, not shown. Once the mechanical folding of the wrapper 5 in the manner described above has been completed, the cam-actuated arm 9 mounted on turret 1 will move into position to capture the inner wrapper 5 in the folded position thus preventing its inherent resiliency from causing the wrapper to unwrap. The above-described operation is schematically illustrated in FIGS. *3a* and *3b*.

In order to form the bottom of the inner wrapper, referring again to FIG. *3b*, the portion 13 of the inner wrapper which projects beyond the bottom of the mandrel and which trails in the direction of rotation 12 is first folded downwardly in the direction of rotation by means of a folding member, not shown. Next, the projecting portion 14 at the leading edge will, by running into a stationery folding member, not shown, be folded downwardly over the wrapper portion 13, this folding being in a direction which is counter to the direction of rotation 12 of the turret. The upper and lower generally triangular-shaped tabs 15 produced by folding wrapper portions 13 and 14 are left extending outwardly as depicted in FIG. *3c* while the outer wrapper 7 is applied.

The folding arm 8 is retracted to enable the outer wrapper 7 to be positioned at the leading side of the mandrel over the inner wrapper 5. This results in the outer wrapper projecting beyond the top and bottom of the mandrel. The folding arm 18 is then reactivated to capture the outer wrapping 7 against the leading side of the mandrel. The mandrel then runs between the stationery folding members 10,11, shown partially, which fold the outer wrapper 7 around the inner wrapper 5 counter to the direction of rotation 12 of turret 1. Next, by means of two folding levers, not shown, the rearwardly projecting flap portions of the outer wrapper 7 are folded around onto the inner wrapper 5 thus producing the partial package depicted in FIG. *3d*.

Referring to FIG. *3e*, while the outer wrapper is held down against the inner wrapper by means of the holding members 8 and 9, the outer wrapper bottom is folded by means of a pair of radially moveable folding thumbs, not shown, which simultaneously fold inwardly the underlying tabs 15 of the inner wrapper 5. Subsequently, the two remaining flaps of the outer wrapper bottom portion are folded over one another by means of folding members, not shown, to complete the wrapper folding operation and produce the product depicted in FIG. *3f*. The folding members which produce this final closing operation will include one stationery member and one moveable member.

In order to prevent the unfolding of the inner wrapper 5, as a consequence of its inherent resiliency, a low pressure is applied to the inside of the mandrels 4 beginning in the region where the inward folding of the bottom flap 13 of the inner wrapper occurs and continuing until the final fold of the bottom of the outer wrapper is completed. The low pressure is applied at the head end of the mandrels, i.e., via the mandrel mouth pieces 3. The low pressure is established in a duct 17 which is connected to a vacuum source via a connector 16. The duct 17 extends over a sector of a circular ring and is provided, on the side which faces the mandrels 4, with an arcuate array of suction orifices 18. The distance between adjacent orifices 18 is less than the width of the mandrels 4 and thus, while any given mandrel is in registration with the duct 17, low pressure will be continuously applied to the inside thereof.

The mandrels 4 are provided with holes or perforations 19 in the side walls thereof which are trailing in the direction of rotation 12 of the turret 1. Accordingly, when the mandrel reaches the position where the folding of the inner wrapper to define the bottom thereof is to be initiated, the interior of the mandrel is subjected to suction via orifices 18 with the low pressure being communicated to the bottom of the mandrel by means of the gaps between the cigarettes 2. Thus, the folded flaps 13,14, see FIGS. *3b* and *3c*, will be kept in the folded position by the applied suction. Simultaneously, the suction exerted by the perforations 19 in the trailing side of the mandrel will keep the flaps 5' and 5'' folded down against the mandrel 4 when the folding member 9 is retracted to permit the folding of the outer wrapper 5. As may be seen from FIG. *2a*, the perforations 19 are appropriately arranged in two rows, located one above another, such that one row of perforations performs the function of retaining the flap portion 5' against the mandrel wall. The suction applied via the other row of perforations functions to retain the flap portion 5'' against the mandrel.

In order to minimize the capacity of the vacuum pump required for operation of the apparatus, cover plates 20 (FIG. 1) will typically be provided to overlie the suction orifices 18 which are located between adjacent of the mandrels 4, such suction plates moving with the turret.

In one reduction to practice of the invention, the duct 17 was connected to a vacuum pump having a capacity of 180 $m^3/h$ and a maximum vacuum of 225 mbar was obtained.

While a preferred embodiment has been shown and described, various modifications and substitutions may be made thereto without departing from the spirit and scope of the invention. Accordingly, it will be understood that the present invention has been described by way of illustration and not limitation.

What is claimed is:

1. In apparatus for use in the packaging of cigarettes, the apparatus including a rotatable turret which supports a plurality of generally rectangularly shaped hollow open-ended mandrels having interiors for receiving blocks of cigarettes, the apparatus further comprising means for supplying generally sheet-like members which are to be formed into inner and outer wrappers into position adjacent the mandrels, the apparatus also comprising folding elements for folding the sheet-like members around a mandrel having a cigarette block disposed therein to sequentially form an inner wrapper on the mandrel and an outer wrapper around the inner wrapper, the improvement comprising:

means for applying a pressure which is lower than the ambient atmosphere pressure to said interiors of the mandrels via a first end thereof during that portion of the rotation of the mandrel when the inner and subsequentially the outer wrapper are folded thereabout; and means for communicating the applied pressure to the inside surface of the inner wrapper at least in the region where a pair of opposite side edges thereof are disposed after the folding to thereby establish a pressure differential which holds the inner wrapper against the mandrel in the folded condition, said communicating means including holes in a first wall of each the mandrels, said mandrel first walls being the trailing walls in the direction of rotation of the turret.

2. The apparatus of claim 1 wherein the means for applying pressure comprises:

a stationary duct which defines a sector of a circle, said duct being positioned so as to be juxtapositioned to the said first ends of the mandrels along a portion of the path of the motion thereof, said duct being provided with a plurality of suction orifices in the side which faces the mandrels, said suction orifices being spaced apart in the direction of motion of the mandrels by a distance which is less than the width of the mandrels.

3. The apparatus of claim 2 wherein said means for applying pressure further comprises:

cover plates mounted for movement with the turret, said cover plates overlying the suction orifices located between adjacent mandrels.

4. The apparatus of claim 2 wherein said suction orifices are arranged along a path which begins where the inner wrapper is folded over the second end of a mandrel, said path continuing at least to the region where the folding of the outer wrapper is completed.

5. The apparatus of claim 4 wherein said means for applying pressure further comprises:

cover plates mounted for movement with the turret, said cover plates overlying the suction orifices located between adjacent mandrels.

6. The apparatus of claim 1 wherein the said inner wrapper comprises a metallized film.

7. The apparatus of claim 3 wherein the said inner wrapper comprises a metallized film.

8. The apparatus of claim 5 wherein the said inner wrapper comprises a metallized film.

* * * * *